US008783820B2

(12) United States Patent
Itoh et al.

(10) Patent No.: US 8,783,820 B2
(45) Date of Patent: Jul. 22, 2014

(54) PRINTER AND PRINTER CONTROL METHOD

(75) Inventors: Masanori Itoh, Nagano (JP); Tadashi Kishida, Nagano (JP); Yoshito Yamaguchi, Nagano (JP); Hideto Tanaka, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 281 days.

(21) Appl. No.: 13/390,938

(22) PCT Filed: May 27, 2010

(86) PCT No.: PCT/JP2010/059015

§ 371 (c)(1),
(2), (4) Date: Apr. 2, 2012

(87) PCT Pub. No.: WO2011/021422

PCT Pub. Date: Feb. 24, 2011

(65) Prior Publication Data

US 2012/0182336 A1 Jul. 19, 2012

(30) Foreign Application Priority Data

Aug. 20, 2009 (JP) ..... 2009-191180

(51) Int. Cl.

| | |
|---|---|
| ***B41J 25/308*** | (2006.01) |
| ***B41J 29/38*** | (2006.01) |
| ***B41J 29/393*** | (2006.01) |
| ***B41J 2/015*** | (2006.01) |
| ***B41J 19/20*** | (2006.01) |
| ***B41J 3/28*** | (2006.01) |

(52) U.S. Cl.
CPC ..... *B41J 19/20* (2013.01); *B41J 19/202* (2013.01); *B41J 3/28* (2013.01)
USPC ..... 347/19; 347/8; 347/9; 347/20

(58) Field of Classification Search
CPC ..... B41J 25/308; B41J 19/005; B41J 19/202; B41J 11/20; B41J 11/14
See application file for complete search history.

(56) References Cited

FOREIGN PATENT DOCUMENTS

| | | |
|---|---|---|
| JP | 11-314421 | 11/1999 |
| JP | 2001-253132 | 9/2001 |

(Continued)

OTHER PUBLICATIONS

"1st Office Action of China Counterpart Application", with English translation thereof, issued on Feb. 10, 2014, P1-P12.

*Primary Examiner* — Jason Uhlenhake
(74) *Attorney, Agent, or Firm* — Jianq Chyun IP Office

(57) ABSTRACT

A printer is provided to improve the conveying accuracy of a Y-bar, thus improving printed image quality. The printer includes the Y-bar that extends in a first direction above a flatbed on which a medium is mounted, holds an ink droplet ejecting head unit so that the head unit is movable in the first direction, and is held so as to be movable with respect to the flatbed in a second direction perpendicular to the first direction. The printer includes a drive mechanism that conveys the Y-bar in the second direction, a drive control device that carries out a drive control of the drive mechanism, and a measuring device that directly measures an amount of movement of the Y-bar with respect to the flatbed. The drive control device corrects controlled variables of the drive mechanism based on the amount of movement of the Y-bar measured by the measuring device.

6 Claims, 4 Drawing Sheets

(56) References Cited

FOREIGN PATENT DOCUMENTS

| | | | | |
|---|---|---|---|---|
| JP | 2004-148745 | 5/2004 | | |
| JP | 2004148745 A | * | 5/2004 | |
| JP | 2006-075772 | | 3/2006 | |
| JP | 2006-224559 | | 8/2006 | |

* cited by examiner

PRINTER AND PRINTER CONTROL METHOD

CROSS-REFERENCE TO RELATED APPLICATION

This application is a 371 of international application of PCT application serial no. PCT/JP2010/059015, filed on May 27, 2010, which claims the priority benefit of Japan application no. 2009-191180, filed on Aug. 20, 2009. The entirety of each of the above-mentioned patent applications is hereby incorporated by reference herein and made a part of this specification.

TECHNICAL FIELD

The present invention relates to a flatbed type printer including a Y-bar that holds a head unit and is held so as to be movable with respect to a flatbed, and to a control method of the printer.

BACKGROUND ART

This kind of flatbed type inkjet printer includes a flatbed on which a medium is mounted, and a Y-bar that holds a head unit, on which are mounted ink droplet ejecting heads, so as to be movable in a scanning direction, and which is held to as to be movable in a conveying direction. The Y-bar is slidably coupled to a pair of guide rails provided on either side portion of the flatbed, and is movable in the conveying direction by a single motor (drive mechanism).

Then, when moving (conveying) the Y-bar in the conveying direction, the amount of movement of the Y-bar in the conveying direction is calculated by an encoder attached to a motor shaft, and the amount of rotation of the motor is controlled (for example, refer to Patent Document 1).

CONVENTIONAL ART DOCUMENTS

Patent Documents

Patent Document 1: JP-A-2001-253132

DISCLOSURE OF INVENTION

Problem to be Solved by the Invention

However, with a large flatbed type inkjet printer, the Y-bar is very long, meaning that, when moving the Y-bar in the conveying direction, there occur mechanical backlash, expansion and contraction of a drive belt, twisting of the Y-bar, and the like. In particular, the effect thereof is pronounced with a large flatbed type inkjet printer such that the length of the Y-bar exceeds 4 m.

Because of this, as the amount of movement of the Y-bar is indirectly calculated in a heretofore known inkjet printer, there is a problem in that a discrepancy occurs between the amount of movement of the Y-bar calculated by the encoder attached to the motor shaft and the actual amount of movement of the Y-bar, and the conveying accuracy of the Y-bar decreases.

Then, as the positioning accuracy of the head unit held by the Y-bar decreases when the conveying accuracy of the Y-bar decreases, the accuracy of the landing positions of the ink droplets ejected from the head unit decreases, and the printed image quality decreases.

Therefore, an object of the invention is to provide a printer and printer control method with which it is possible to improve the conveying accuracy of the Y-bar, thus improving printed image quality.

Means for Solving the Problems

A printer according to the invention includes a Y-bar that extends in a first direction above a flatbed on which a medium is mounted, holds an ink droplet ejecting head unit so that the head unit is movable in the first direction, and is held so as to be movable with respect to the flatbed in a second direction perpendicular to the first direction, the printer including a drive mechanism that conveys the Y-bar in the second direction, a drive control device that carries out a drive control of the drive mechanism, and a measuring device that directly measures an amount of movement of the Y-bar with respect to the flatbed, wherein the drive control device corrects controlled variables of the drive mechanism based on the amount of movement of the Y-bar measured by the measuring device.

According to the printer according to the invention, it is possible to print an image on a medium mounted on the flatbed by causing ink droplets to be ejected from the head unit while moving the head unit in the first direction, and moving the Y-bar in the second direction. At this time, by directly measuring the amount of movement of the Y-bar with respect to the flatbed, it is possible to obtain the actual amount of movement of the Y-bar with respect to the controlled variables of the drive mechanism. Therefore, it is possible to improve the Y-bar conveying accuracy by correcting the controlled variables of the drive mechanism based on the amount of movement of the Y-bar directly measured by the measuring device. Because of this, as it is possible to improve the accuracy of the landing positions of the ink droplets ejected from the head unit, it is possible to improve the printed image quality.

In this case, it is preferable that the drive mechanism includes a first drive mechanism that conveys one end portion in the first direction of the Y-bar and a second drive mechanism that conveys the other end portion in the first direction of the Y-bar. In this way, by independently conveying the two end portions in the first direction of the Y-bar using the first drive mechanism and second drive mechanism, it is possible to adjust a tilt of the Y-bar. Because of this, even in the event that the Y-bar becomes longer in the first direction, it is possible to equalize the amounts of movement of the two end portions in the first direction of the Y-bar, thus suppressing a tilt of the Y-bar.

Then, it is preferable that the measuring device includes a first measuring device that measures an amount of movement of one end portion in the first direction of the Y-bar and a second measuring device that measures an amount of movement of the other end portion in the first direction of the Y-bar. In this way, by independently measuring the one end portion and other end portion of the Y-bar using the first measuring device and second measuring device, it is possible to detect a tilt of the Y-bar with greater accuracy, and it is thus possible to correct a tilt of the Y-bar with high accuracy.

Also, it is preferable that the measuring device includes a linear scale attached to the flatbed and a linear encoder, attached to the Y-bar, that detects the linear scale. In this way, by using the linear scale and linear encoder, it is possible to detect the amount of movement of the Y-bar with respect to the flatbed with high accuracy.

Also, it is preferable that the first drive mechanism and second drive mechanism include a drive pulley and an idler pulley aligned in the second direction, a timing belt suspended between the drive pulley and idler pulley and coupled to the Y-bar, and a motor that causes the drive pulley to rotate. Normally, the Y-bar is conveyed using a highly rigid member such as a ball screw but, as this kind of member is expensive, it is not satisfactory from a cost aspect. Therefore, by employing a simple configuration of the drive pulley, the idler pulley, the timing belt, and the motor as the first drive mechanism and second drive mechanism in this way, it is possible to use members that are low-cost in comparison with a member such as a ball screw, meaning that it is possible to reduce cost while reliably conveying the two end portions in the first direction of the Y-bar in the second direction.

A printer control method according to the invention is a control method of a printer including a Y-bar that extends in a first direction above a flatbed on which a medium is mounted, holds a head unit that ejects ink droplets so that the head unit is movable in the first direction, and is held so as to be movable with respect to the flatbed in a second direction perpendicular to the first direction, the method including a conveying step of conveying the Y-bar in the second direction, a measuring step of directly measuring an amount of movement of the Y-bar with respect to the flatbed, and a correction step of correcting controlled variables of the Y-bar conveyed in the conveying step based on the amount of movement of the Y-bar measured in the measuring step.

According to the printer control method according to the invention, it is possible to print an image on a medium mounted on the flatbed by causing ink droplets to be ejected from the head unit while moving the head unit in the first direction, and moving the Y-bar in the second direction. At this time, by directly measuring the amount of movement of the Y-bar with respect to the flatbed, it is possible to obtain the actual amount of movement of the Y-bar. Therefore, it is possible to improve the Y-bar conveying accuracy by correcting the controlled variables conveying the Y-bar based on the amount of movement of the Y-bar directly measured in the measuring step. Because of this, as it is possible to improve the accuracy of the landing positions of the ink droplets ejected from the head unit, it is possible to improve the printed image quality.

In this case, it is preferable that the conveying step is such that one end portion in the first direction of the Y-bar and the other end portion in the first direction of the Y-bar are conveyed independently. In this way, by independently conveying the two end portions in the first direction of the Y-bar, it is possible to adjust a tilt of the Y-bar. Because of this, even in the event that the Y-bar becomes longer in the first direction, it is possible to equalize the amounts of movement of the two end portions in the first direction of the Y-bar, thus suppressing a tilt of the Y-bar.

Also, it is preferable that the measuring step is such that an amount of movement of one end portion in the first direction of the Y-bar and an amount of movement of the other end portion in the first direction of the Y-bar are measured independently. In this way, by independently measuring the one end portion and other end portion of the Y-bar, it is possible to detect a tilt of the Y-bar with greater accuracy, and it is thus possible to correct a tilt of the Y-bar with high accuracy.

Advantage of the Invention

According to the invention, it is possible to improve the conveying accuracy of the Y-bar, thus improving printed image quality.

DESCRIPTION OF EMBODIMENTS

Figure 1:
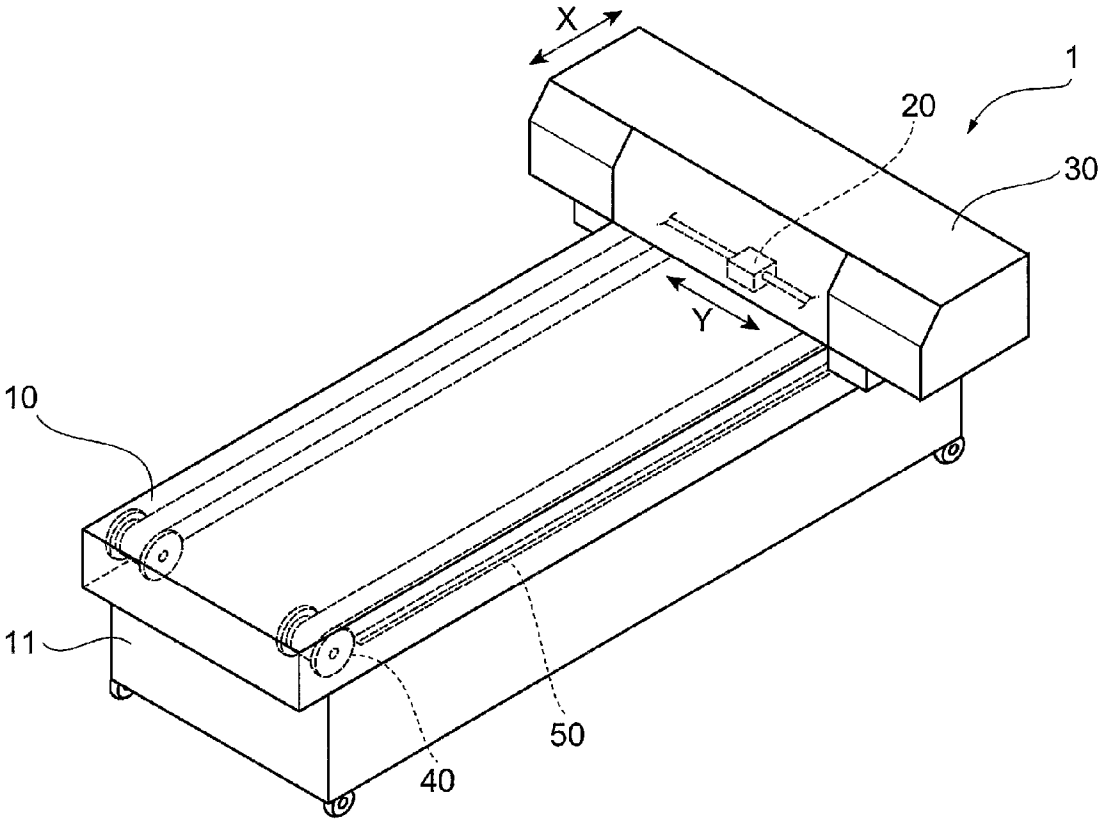
FIG. 1 is an outline perspective view showing an inkjet printer according to an embodiment.

Hereafter, referring to the drawings, a detailed description will be given of a preferred embodiment of an inkjet printer according to the invention. The same reference numerals and signs are given to the same or corresponding portions in all the drawings.

Figure 2:
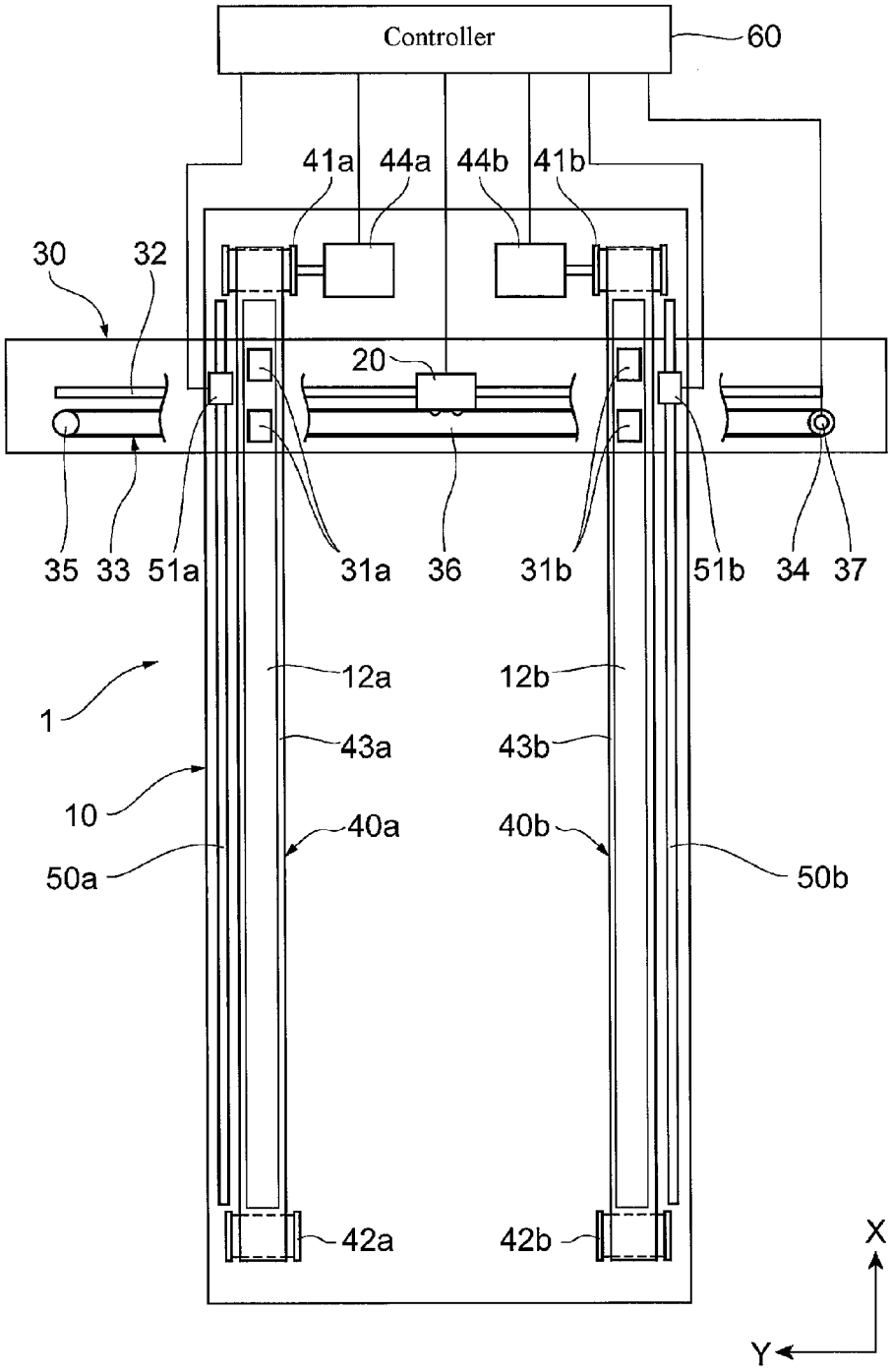
FIG. 2 is an outline plan view showing a functional configuration of the inkjet printer shown in FIG. 1.

FIG. 1 is an outline perspective view showing the inkjet printer according to the embodiment, while FIG. 2 is an outline plan view showing a functional configuration of the inkjet printer shown in FIG. 1. As shown in FIG. 1 and FIG. 2, an inkjet printer 1 has, as main components, a flatbed 10, on which a printing target medium (not shown) is mounted and fixed, and a Y-bar 30, on which is mounted a head unit 20 that ejects ink droplets. Then, the inkjet printer 1, in a condition in which the medium is mounted and fixed on the flatbed 10, prints an image on the medium by the head unit 20 being moved in a scanning direction and the Y-bar 30 being conveyed in a conveying direction perpendicular to the scanning direction. Therefore, a detailed description will be given hereafter of a configuration of the inkjet printer 1. In the following description, the scanning direction is taken to be a Y axis direction and the conveying direction is taken to be an X axis direction.

The flatbed 10 is supported at a predetermined height by a base portion 11 of a frame configuration, and a medium is mounted on, and fixed by adsorption to, an upper surface of the flatbed 10. For this reason, the upper surface of the flatbed 10 is formed planarly, and plural suction holes (not shown) suctioned by a suction device (not shown) are formed therein.

Then, a pair of rails 12 on which the Y-bar 30 is mounted, which hold the Y-bar 30 so that it can move in the X axis direction, and a drive mechanism 40 for conveying the Y-bar 30 in the X axis direction, are provided on the flatbed 10.

As shown in FIG. 2, the pair of rails 12 are configured of a first rail 12*a*, provided in one end portion (the left side end portion in FIG. 2) in the Y axis direction of the flatbed 10, and a second rail 12*b*, provided in the other end portion (the right side end portion in FIG. 2) in the Y axis direction of the flatbed 10. That is, the Y-bar 30 is held by the first rail 12*a* and second rail 12*b* in either end portion in the Y axis direction of the flatbed 10.

The drive mechanism 40 is configured of a first drive mechanism 40*a*, provided in one end portion in the Y axis direction of the flatbed 10, and a second drive mechanism 40*b*, provided in the other end portion in the Y axis direction of the flatbed 10.

The first drive mechanism 40*a* includes a drive pulley 41*a* and idler pulley 42*a* aligned in the X axis direction, a timing belt 43*a* suspended between the drive pulley 41*a* and idler pulley 42*a*, and a drive motor 44*a*, coupled to the rotary shaft of the drive pulley 41*a*, that rotationally drives the drive pulley 41*a*. Then, the timing belt 43*a* is coupled to one end portion (the left side end portion in FIG. 2) in the Y axis direction of the Y-bar 30. A highly rigid timing belt having carbon as a main component being employed as the timing belt 43*a*, the expansion and contraction rate is kept low. Also, the drive motor 44*a* and drive pulley 41*a* are coupled via an attenuator (not shown) that has a predetermined damping ratio.

Then, the first drive mechanism 40*a* is such that, when the drive motor 44*a* is rotationally driven, the drive pulley 41*a* coupled to the drive shaft of the drive motor 44*a* rotates, and one end portion of the Y-bar 30 is pulled in the X axis direction by the timing belt 43*a* suspended between the drive pulley 41*a* and idler pulley 42*a* rotating.

The second drive mechanism 40*b* includes a drive pulley 41*b* and idler pulley 42*b* aligned in the X axis direction, a timing belt 43*b* suspended between the drive pulley 41*b* and idler pulley 42*b*, and a drive motor 44*b*, coupled to the rotary shaft of the drive pulley 41*b*, that rotationally drives the drive pulley 41*b*. Then, the timing belt 43*b* is coupled to the other end portion (the right side end portion in FIG. 2) in the Y axis direction of the Y-bar 30. A highly rigid timing belt having carbon as amain component being employed as the timing belt 43*b*, the expansion and contraction rate is kept low. Also, the drive motor 44*b* and drive pulley 41*b* are coupled via an attenuator (not shown) that has a predetermined damping ratio.

Then, the second drive mechanism 40*b* is such that, when the drive motor 44*b* is rotationally driven, the drive pulley 41*b* coupled to the drive shaft of the drive motor 44*b* rotates, and the other end portion of the Y-bar 30 is pulled in the X axis direction by the timing belt 43*b* suspended between the drive pulley 41*b* and idler pulley 42*b* rotating.

In this way, the first drive mechanism 40*a* and second drive mechanism 40*b*, having the same configuration, are configured axisymmetrically with respect to a central line that passes through a center in the Y axis direction of the flatbed 10 and extends in the X axis direction. Because of this, it is possible to convey the Y-bar 30 in the X axis direction while holding it well-balanced in the Y axis direction.

Furthermore, a linear scale 50*a* disposed along the timing belt 43*a* of the first drive mechanism 40*a* and a linear scale 50*b* disposed along the timing belt 43*b* of the second drive mechanism 40*b* are attached to the flatbed 10.

The linear scale 50*a* is a scale, attached to one end portion in the Y axis direction of the flatbed 10, for measuring the amount of movement of one end portion in the Y axis direction of the Y-bar 30 using an optical linear encoder 51*a*, to be described hereafter, mounted on the Y-bar 30. For this reason, the linear scale 50*a* is formed in an elongated strip form extending in the X axis direction, and slits are formed therein at a pitch of several to several tens of micrometers.

The linear scale 50*b* is a scale, attached to the other end portion in the Y axis direction of the flatbed 10, for measuring the amount of movement of the other end portion in the Y axis direction of the Y-bar 30 using an optical linear encoder 51*b*, to be described hereafter, mounted on the Y-bar 30. For this reason, the linear scale 50*b* is formed in an elongated strip form extending in the X axis direction, and slits are formed therein at a pitch of several to several tens of micrometers.

In this way, the linear scale 50*a* and linear scale 50*b*, having the same configuration, are configured axisymmetrically with respect to a central line in the Y axis direction of the flatbed 10. Because of this, it is possible to measure the amounts of movement of the two end portions in the Y axis direction of the Y-bar 30 under essentially the same conditions.

The Y-bar 30 is supported by the first rail 12*a* and second rail 12*b* of the flatbed 10 so as to be movable in the X axis direction, conveys the head unit 20 in the Y axis direction, and is conveyed in the X axis direction with respect to the flatbed 10. For this reason, a first roller 31*a* that rolls in the X axis direction guided by the first rail 12*a*, a second roller 31*b* that rolls in the X axis direction guided by the second rail 12*b*, a slider shaft 32 that supports the head unit 20 so that it is movable in the Y axis direction, and a head unit drive mechanism 33 that conveys the head unit 20 in the Y axis direction along the slider shaft 32, are provided on the Y-bar 30.

The head unit drive mechanism 33, having the same kind of configuration as the heretofore described first drive mechanism 40*a* and second drive mechanism 40*b*, is configured of a drive pulley 34 and idler pulley 35 aligned in the Y axis direction, a timing belt 36 suspended between the drive pulley 34 and idler pulley 35 and coupled to the head unit 20, and a drive motor 37 that rotationally drives the drive pulley 34.

Then, the head unit drive mechanism 33 is such that, when the drive motor 37 is rotationally driven, the drive pulley 34 coupled to the drive shaft of the drive motor 37 rotates, and the head unit 20 is pulled in the Y axis direction by the timing belt 36 suspended between the drive pulley 34 and idler pulley 35 rotating.

Furthermore, the optical linear encoder 51*a*, disposed in an upper position opposed to the linear scale 50*a*, and the optical linear encoder 51*b*, disposed in an upper position opposed to the linear scale 50*b*, are provided on the Y-bar 30.

The optical linear encoder 51*a*, being an encoder (measuring instrument) that detects the slits formed in the linear scale 50*a*, measures the amount of movement of the optical linear encoder 51*a* with respect to the linear scale 50*a* by counting the slits. For example, the optical linear encoder 51*a*, by emitting an infrared light and analyzing the waveform of the infrared light reflected from the linear scale 50*a*, can detect the slits of the linear scale 50*a*, and count the slits. Then, as the linear scale 50*a* is attached to one end portion in the Y axis direction of the flatbed 10, and the optical linear encoder 51*a* is attached to one end portion in the Y axis direction of the Y-bar 30, the optical linear encoder 51*a*, by counting the slits formed in the linear scale 50*a*, directly measures the amount of movement of the one end portion in the Y axis direction of the Y-bar 30 with respect to the flatbed 10.

The optical linear encoder 51*b*, being an encoder (measuring instrument) that detects the slits formed in the linear scale 50*b*, measures the amount of movement of the optical linear encoder 51*b* with respect to the linear scale 50*b* by counting the slits. For example, the optical linear encoder 51*b*, by emitting an infrared light and analyzing the waveform of the infrared light reflected from the linear scale 50*b*, can detect the slits of the linear scale 50*b*, and count the slits. Then, as the linear scale 50*b* is attached to the other end portion in the Y axis direction of the flatbed 10, and the optical linear encoder 51*b* is attached to the other end portion in the Y axis direction of the Y-bar 30, the optical linear encoder 51*b*, by counting the slits formed in the linear scale 50*b*, directly measures the amount of movement of the other end portion in the Y axis direction of the Y-bar 30 with respect to the flatbed 10.

Then, a controller 60 that carries out a print control is provided in the inkjet printer 1.

The controller 60 is electrically connected to the head unit 20, the drive motor 37 of the head unit drive mechanism 33, the drive motor 44*a* of the first drive mechanism 40*a*, the drive motor 44*b* of the second drive mechanism 40*b*, the optical linear encoder 51*a*, and the optical linear encoder 51*b*. Then, the controller 60, controlling the head unit 20, drive motor 37, drive motor 44*a*, and drive motor 44*b*, carries out a print control whereby an image is printed on a medium mounted on the flatbed 10. Furthermore, the controller 60, based on results of measurements by the optical linear encoder 51*a* and optical linear encoder 51*b*, corrects the controlled variables of the drive motor 44*a* and drive motor 44*b*.

Figure 3:
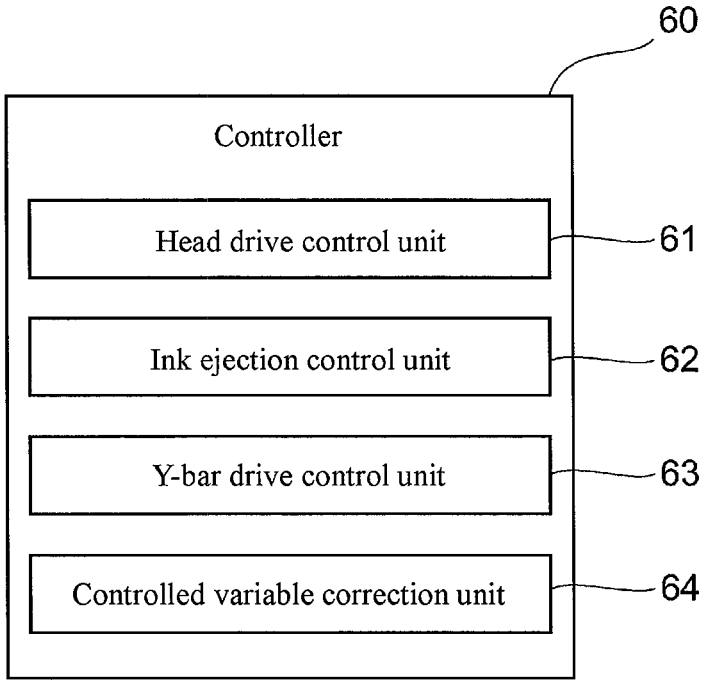
FIG. 3 is a block diagram showing a functional configuration of a controller.

FIG. 3 is a block diagram showing an example of a functional configuration of the controller. As shown in FIG. 3, the controller 60 functions as a head drive control unit 61, an ink ejection control unit 62, a Y-bar drive control unit 63, and a controlled variable correction unit 64. The controller 60 is configured based on a computer including, for example, a CPU, a ROM, and a RAM. Then, each function of the controller 60 described hereafter is realized by loading predetermined computer software onto the CPU or RAM, and operating it under a control by the CPU.

The head drive control unit 61 carries out a drive control of the drive motor 37, thus conveying the head unit 20 in the Y axis direction.

The ink ejection control unit 62, when the head unit 20 is being conveyed in the Y axis direction by the head drive control unit 61, carries out a head unit 20 ink ejection control, thus causing ink droplets to be ejected from the head unit 20.

When one pass of image printing is finished by the drive control of the drive motor 37 by the head drive control unit 61 and the head unit 20 ink ejection control by the ink ejection control unit 62, the Y-bar drive control unit 63 carries out a drive control of the drive motor 44*a* and a drive control of the drive motor 44*b*, thus conveying the Y-bar 30 an amount equivalent to one pass in the X axis direction.

The controlled variable correction unit 64 corrects the controlled variables of the drive motor 44*a* and drive motor 44*b* by analyzing the results of measurements by the optical linear encoder 51*a* and optical linear encoder 51*b*, thus adjusting the amount of movement of the one end portion and other end portion in the Y axis direction of the Y-bar 30.

Figure 4:
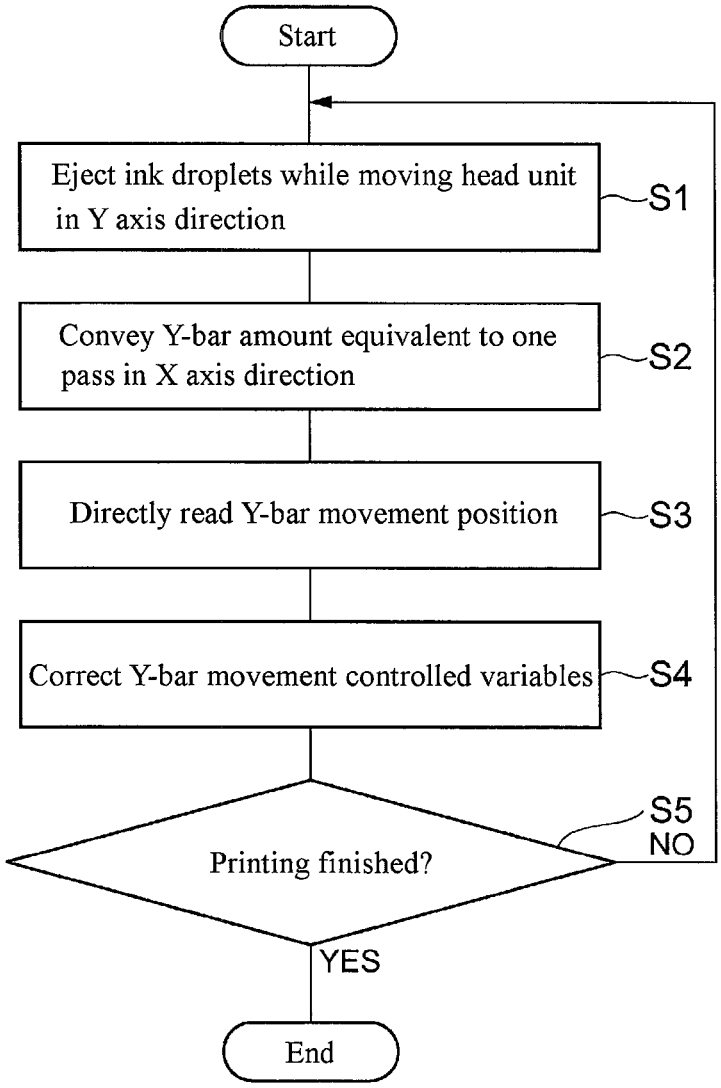
FIG. 4 is a flowchart showing a processing action of the controller.

Next, while referring to FIG. 4, a description will be given of a processing action of the inkjet printer 1 according to the embodiment. FIG. 4 is a flowchart showing a processing by the controller. The processing action of the inkjet printer 1 described hereafter is carried out by a control by the controller 60. That is, the controller 60 is such that the following processing is carried out by a processing unit (not shown) configured of the CPU and the like integrally controlling the functions of the head drive control unit 61, ink ejection control unit 62, Y-bar drive control unit 63, controlled variable correction unit 64, and the like, in accordance with a program recorded on a storage device such as the ROM.

The controller 60 starts the following processing on print data (a drawing command) being forwarded from an external device to the inkjet printer 1.

As shown in FIG. 4, firstly, the controller 60 causes ink droplets to be ejected from the head unit 20 while moving the head unit 20 in the Y axis direction (step S1). That is, in step S1, the controller 60 carries out a drive control of the drive motor 37 and carries out a head unit 20 ink ejection control, thus causing ink droplets to be ejected from the head unit 20 while moving the head unit 20 in the Y axis direction. By so doing, one pass of image is printed on a medium fixed by adsorption to the upper surface of the flatbed 10.

Next, the controller 60 conveys the Y-bar 30 an amount equivalent to one pass in the X axis direction (step S2). That is, in step S2, the controller 60 carries out a drive control of the drive motor 44*a* and drive motor 44*b* with controlled variables necessary in order to convey the Y-bar 30 an amount equivalent to one pass. At this time, the drive control of the drive motor 44*a* and drive motor 44*b* is carried out based on controlled variables corrected in step S4, to be described hereafter. Then, the rotary drive of the drive motor 44*a* is transmitted to the drive pulley 41*a*, the timing belt 43*a* suspended between the drive pulley 41*a* and idler pulley 42*a* rotates, and the one end portion in the Y axis direction of the Y-bar 30 is pulled an amount equivalent to one pass in the X axis direction. In the same way, the rotary drive of the drive motor 44*b* is transmitted to the drive pulley 41*b*, the timing belt 43*b* suspended between the drive pulley 41*b* and idler pulley 42*b* rotates, and the other end portion in the Y axis direction of the Y-bar 30 is pulled an amount equivalent to one pass in the X axis direction. Because of this, the whole of the Y-bar 30 is conveyed an amount equivalent to one pass in the X axis direction. At this time, the optical linear encoder 51*a* and optical linear encoder 51*b* attached to the Y-bar 30 detect the slits of the linear scale 50*a* and linear scale 50*b* attached to the flatbed 10, and count the number thereof.

Next, the controller 60 directly measures the amount of movement of the Y-bar 30 (step S3). That is, in step S3, the controller 60 acquires the count value of the slits of the linear scale 50*a* and linear scale 50*b* counted by the optical linear encoder 51*a* and optical linear encoder 51*b* when the Y-bar 30 is conveyed an amount equivalent to one pass in the X axis direction in step S2. Then, based on the count value acquired from the optical linear encoder 51*a*, the controller 60 measures the amount of movement of the one end portion in the Y axis direction of the Y-bar 30 with respect to the flatbed 10. In the same way, based on the count value acquired from the optical linear encoder 51*b*, the controller 60 measures the amount of movement of the other end portion in the Y axis direction of the Y-bar 30 with respect to the flatbed 10. At this time, due to twisting, mechanical error, or the like, of the Y-bar 30, the amount of movement of the one end portion and the amount of movement of the other end portion in the Y axis direction of the Y-bar 30 do not necessarily always coincide.

Next, the controller 60, based on the amount of movement of the one end portion and the amount of movement of the other end portion in the Y axis direction of the Y-bar 30 directly measured in step S3, corrects the controlled variables for driving the drive motor 44*a* and the controlled variables for driving the drive motor 44*b* in step S2 (step S4). That is, in step S4, the controller 60 determines whether or not the amount of movement of the one end portion and the amount of movement of the other end portion in the Y axis direction of the Y-bar 30 directly measured in step S3 is an amount equivalent to one pass by which the Y-bar 30 is to be conveyed by the controller 60 in step S2. Then, in the event that the amount of movement of the one end portion in the Y axis direction of the Y-bar 30 directly measured in step S3 is not the amount equivalent to one pass to be conveyed in step S2, the controller 60 calculates the correction value of the difference, and corrects the controlled variables for driving the drive motor 44*a* in step S2. In the same way, in the event that the amount of movement of the other end portion in the Y axis direction of the Y-bar 30 directly measured in step S3 is not the amount equivalent to one pass to be conveyed in step S2, the controller 60 calculates the correction value of the difference, and corrects the controlled variables for driving the drive motor 44*b* in step S2.

Then, in step S2 in the next cycle, the drive motor 44*a* and drive motor 44*b* are drive controlled using the controlled variables corrected in step S4, meaning that the one end portion and other end portion in the Y axis direction of the Y-bar 30 are accurately conveyed an amount equivalent to one pass, and the discrepancy between the amount of movement of the one end portion and the amount of movement of the other end portion in the Y axis direction of the Y-bar 30 is eliminated or reduced.

Next, the controller 60 determines whether or not all the print data forwarded from the external device have been printed (step S5).

Then, if it is determined that not all the print data have been printed (step S5: NO), the controller 60 returns to step S1, and repeats the heretofore described step S1 to step S4 again.

Meanwhile, if it is determined that all the print data have been printed (step S5: YES), the controller 60 finishes the printing process.

In this way, according to the inkjet printer 1 according to the embodiment, it is possible to print an image on a medium mounted on the flatbed 10 by causing ink droplets to be ejected from the head unit 20 while moving the head unit 20 in the Y axis direction, and moving the Y-bar 30 in the X axis direction. At this time, by directly measuring the amount of movement of the Y-bar 30 with respect to the flatbed 10, it is possible to obtain the actual amount of movement of the Y-bar 30 with respect to the controlled variables of the first drive mechanism 40*a* and second drive mechanism 40*b*. Therefore, it is possible to improve the Y-bar 30 conveying accuracy by correcting the controlled variables of the first drive mechanism 40*a* and second drive mechanism 40*b* based on the amount of movement of the Y-bar 30 directly measured by the optical linear encoder 51*a* and optical linear encoder 51*b*. Because of this, as it is possible to improve the accuracy of the landing positions of the ink droplets ejected from the head unit 20, it is possible to improve the printed image quality.

In this case, by independently conveying the two end portions in the Y axis direction of the Y-bar 30 using the double drive of the first drive mechanism 40*a* and second drive mechanism 40*b*, it is possible to adjust a tilt of the Y-bar 30 with respect to the Y axis direction. Because of this, even in the event that the Y-bar 30 becomes longer in the Y axis direction due to an increase in size of the inkjet printer 1, it is possible to equalize the amounts of movement of the two end portions in the Y axis direction of the Y-bar 30, thus suppressing a tilt of the Y-bar 30.

Then, by independently measuring the one end portion and other end portion in the Y axis direction of the Y-bar 30 using the optical linear encoder 51*a* and optical linear encoder 51*b*, it is possible to detect a tilt of the Y-bar 30 with greater accuracy, and it is thus possible to correct a tilt of the Y-bar 30 with high accuracy.

Also, by carrying out the measurement of the amount of movement of the Y-bar 30 with respect to the flatbed 10 using the linear scale 50*a* and optical linear encoder 51*a* and the linear scale 50*b* and optical linear encoder 51*b*, it is possible to detect the amount of movement of the Y-bar 30 with respect to the flatbed 10 with high accuracy.

By employing a simple configuration of the drive pulley 41*a* and drive pulley 41*b*, the idler pulley 42*a* and idler pulley 42*b*, the timing belt 43*a* and timing belt 43*b*, and the drive motor 44*a* and drive motor 44*b* as the first drive mechanism 40*a* and second drive mechanism 40*b*, it is possible to use members that are low-cost in comparison with a member such as a ball screw, meaning that it is possible to reduce cost while reliably conveying the two end portions in the Y axis direction of the Y-bar 30 in the X axis direction.

Heretofore, a description has been given of a preferred embodiment of the invention, but the invention is not limited to the heretofore described embodiment. For example, in the heretofore described embodiment, a description has been given whereby the movement of the Y-bar 30 in the X axis direction and the movement of the head unit 20 in the Y axis direction are carried out using a belt drive including drive pulleys, idler pulleys, timing belts, and drive motors, but they may also be carried out using, for example, a ball screw mechanism including a ball screw, a ball bearing coupled to the Y-bar 30 or head unit 20, and a drive motor that rotationally drives the ball screw, or the like.

Also, in the heretofore described embodiment, a description has been given whereby the measurement of the amount of movement of the Y-bar 30 in the X axis direction is carried out using linear scales and optical linear encoders, but it may also be carried out using, for example, a rotary encoder, a magnetic measuring device, range instrumentation radar, or the like. When using a rotary encoder, a wheel, which is a rotary encoder jig, is attached to the Y-bar 30 so as to be able to rotate in the Y axis direction, and the wheel is brought into contact with the flatbed 10. A material with a high friction coefficient is used for the outer peripheral surface of the wheel so that it does not slip over the flatbed 10. Then, as the wheel attached to the Y-bar 30 rolls over the flatbed 10 when the Y-bar 30 is moved in the X axis direction, it is possible to directly measure the amount of movement of the Y-bar 30 in the X axis direction by detecting the amount of rotation of the wheel. Also, when using a magnetic measuring device, a magnetic tape on which are recorded marks such as calibrations is stuck to the flatbed 10, and a magnetic head that reads recording information from the magnetic tape is attached to the Y-bar 30. Then, as recording information is read from the magnetic tape stuck to the flatbed 10 by the magnetic head attached to the Y-bar 30 when the Y-bar 30 is moved in the X axis direction, it is possible to directly measure the amount of movement of the Y-bar 30 in the X axis direction by detecting the recording information.

Also, in the heretofore described embodiment, a description has been given whereby a left-right independent drive method of the first drive mechanism 40*a* and second drive mechanism 40*b* is employed for the conveying of the Y-bar 30 in the X axis direction, but an interlocked drive system, wherein the drive pulley 41*a* of the first drive mechanism 40*a* and the drive pulley 41*b* of the second drive mechanism 40*b* are coupled on one drive shaft, and the drive shaft is rotationally driven by a single drive motor, may also be employed.

Also, in the heretofore described embodiment, a description has been given whereby the amount of movement of the Y-bar 30 in the X axis direction is measured directly but, for example, a movement position of the Y-bar 30 in the X axis direction may be read directly, and the amount of movement of the Y-bar 30 in the X axis direction may be calculated from the directly read movement position.

Also, in the heretofore described embodiment, a description has been given whereby the amount of conveying equivalent to one pass by which the Y-bar 30 is conveyed each time is taken to be fixed, but the amount of conveying equivalent to one pass maybe changed as appropriate depending on, for example, the kind of medium, the kind of ink, or the like.

Also, in the heretofore described embodiment, a description has been given whereby slits are formed in the linear scales 50*a* and 50*b*, but raised gradations may be formed instead of the slits. In this case, the optical linear encoders 51*a* and 51*b*, by counting the number of raised gradations formed on the linear scales 50*a* and 50*b*, can measure the amount of movement of the optical linear encoders 51*a* and 51*b* with respect to the linear scales 50*a* and 50*b*. Because of this, it is possible to directly measure the amount of movement of one end portion in the Y axis direction of the Y-bar 30 with respect to the flatbed 10.

Also, in the heretofore described embodiment, a description has been given of an example wherein the timing belts 43*a* and 43*b* have carbon as a main component but, any material being sufficient provided that it has high rigidity, the timing belts 43*a* and 43*b* may be, for example, steel belts, or belts with an iron core.

INDUSTRIAL APPLICABILITY

The invention can be utilized as a printer.

The invention claimed is:

1. A printer including a Y-bar that extends in a first direction above a flatbed on which a medium is mounted, holds an ink droplet ejecting head unit so that the head unit is movable in the first direction, and is held so as to be movable with respect to the flatbed in a second direction perpendicular to the first direction, the printer including:

a drive mechanism that conveys the Y-bar in the second direction;

a drive control device that carries out a drive control of the drive mechanism; and a measuring device that directly measures an amount of movement of the Y-bar with respect to the flatbed, wherein the drive control device corrects controlled variables of the drive mechanism based on the amount of movement of the Y-bar measured by the measuring device, wherein the drive mechanism includes:

a first drive mechanism that conveys one end portion in the first direction of the Y-bar; and a second drive mechanism that conveys the other end portion in the first direction of the Y-bar.

2. The printer according to claim 1, wherein the measuring device includes:

a first measuring device that measures an amount of movement of one end portion in the first direction of the Y-bar; and a second measuring device that measures an amount of movement of the other end portion in the first direction of the Y-bar.

3. The printer according to claim 1, wherein the measuring device includes:

a linear scale attached to the flatbed; and a linear encoder, attached to the Y-bar, that detects the linear scale.

4. The printer according to claim 1, wherein the first drive mechanism and second drive mechanism include:

a drive pulley and an idler pulley aligned in the second direction;

a timing belt suspended between the drive pulley and idler pulley and coupled to the Y-bar; and a motor that causes the drive pulley to rotate.

5. A control method of a printer including a Y-bar that extends in a first direction above a flatbed on which a medium is mounted, holds a head unit that ejects ink droplets so that the head unit is movable in the first direction, and is held so as to be movable with respect to the flatbed in a second direction perpendicular to the first direction, the method including:

a conveying step of conveying the Y-bar in the second direction;

a measuring step of directly measuring an amount of movement of the Y-bar with respect to the flatbed; and a correction step of correcting controlled variables of the Y-bar conveyed in the conveying step based on the amount of movement of the Y-bar measured in the measuring step, wherein the conveying step is such that one end portion in the first direction of the Y-bar and the other end portion in the first direction of the Y-bar are conveyed independently.

6. The printer control method according to claim 5, wherein the measuring step is such that an amount of movement of one end portion in the first direction of the Y-bar and an amount of movement of the other end portion in the first direction of the Y-bar are measured independently.

* * * * *